US006905281B2

(12) United States Patent
Kang

(10) Patent No.: US 6,905,281 B2
(45) Date of Patent: Jun. 14, 2005

(54) VEHICULAR IMPACT ABSORBING APPARATUS HAVING CUSHION PINS

(76) Inventor: Sung Ku Kang, 113-1602 Hansin Apt., 1212-1 Jaegi-dong, Dongdaemoon-gu, Seoul, 130-772 (KR)

( * ) Notice: Subject to any disclaimer, the term of this patent is extended or adjusted under 35 U.S.C. 154(b) by 0 days.

(21) Appl. No.: 10/438,351

(22) Filed: May 12, 2003

(65) Prior Publication Data

US 2003/0210954 A1 Nov. 13, 2003

(30) Foreign Application Priority Data

May 13, 2002 (KR) ..... 10-2002-0026152
May 7, 2003 (KR) ..... 10-2003-0029084

(51) Int. Cl.[7] ..... E01F 15/00
(52) U.S. Cl. ..... 404/6; 404/9
(58) Field of Search ..... 404/6, 9, 10; 256/13.1

(56) References Cited

U.S. PATENT DOCUMENTS 4,823,923 A * 4/1989 Moyer ..... 188/376
5,192,157 A * 3/1993 Laturner ..... 404/6
5,217,318 A * 6/1993 Peppel ..... 404/6
5,642,792 A 7/1997 June ..... 183/188
5,645,368 A * 7/1997 Yunick ..... 404/6
5,868,521 A 2/1999 Oberth et al. ..... 404/6
5,947,452 A 9/1999 Albritton ..... 256/13.1
6,010,275 A * 1/2000 Fitch ..... 404/6
6,179,516 B1 1/2001 Ivey et al. ..... 404/6
6,427,983 B1 * 8/2002 Leonhardt et al. ..... 256/13.1
6,461,076 B1 10/2002 Stephens et al. ..... 404/6
6,536,986 B1 * 3/2003 Anghileri et al. ..... 404/6
2003/0081997 A1 * 5/2003 Kramer ..... 404/6

FOREIGN PATENT DOCUMENTS

KR 2000058242 7/2001
WO WO 00/52267 9/2000

* cited by examiner

*Primary Examiner*—Thomas B. Will
*Assistant Examiner*—Raymond W Addie
(74) *Attorney, Agent, or Firm*—Sheridan Ross PC

(57) ABSTRACT

A vehicular impact absorbing apparatus includes a pair of tubular guide rails having a guide slit longitudinally formed at the upper part of each guide rail fixed to the ground. Sliders are movably mounted in the guide rail at predetermined intervals, the upper part of each slider is laid on the upper part of the guide rail through the guide slit. Cushion units are mounted on the upper part of each slider. Each cushion unit is elastically deformed by vehicular impact while retracting along the guide rail. Cushion pins are mounted across the guide rails at predetermined intervals between the sliders that also absorb the kinetic energy of an impact by being broken by the rearward retracting slider. A stopper is installed around the rear end of the guide rail for stopping the retracting cushion units. A successive cushion and deceleration of the impact is possible in this arrangement.

15 Claims, 15 Drawing Sheets

VEHICULAR IMPACT ABSORBING APPARATUS HAVING CUSHION PINS

BACKGROUND OF THE INVENTION

1. Field of the Invention

The present invention relates to a safety guard installed on a roadway at which a vehicular impact is expected, and more particularly to a vehicular impact absorbing apparatus having cushion pins, which ensure effective arrest of vehicle impacts.

2. Description of the Prior Art

There are several general types of roadway safety facilities, including for example, guard rails for protecting vehicles from deviating from the road and median dividers for preventing intrusion of a vehicle into the opposite lane. Further, safety guards or crash cushions are installed alongside roadways in front of obstructions such as concrete walls, the ends of dividers, toll booths and the like for protecting them against vehicular impact as well as protecting passengers during a car crash.

The guard rail and the median divider seldom collide head-on with a vehicle as they are disposed along by the road. However, the safe guard is apt to collide head-on with vehicles since it is located infront of the driving direction of oncoming automobiles.

In the event of a head-on collision with the safe guard, enormous impact energy is applied to the vehicle which can result in a fatal blow to the vehicle and passenger. Therefore, it is desirable that the safe guard effectively absorbs kinetic energy of an impacting vehicle to minimize injury of passengers and to reduce damage to roadway facilities as well as the vehicle.

A common type of safety guard is formed by a concrete structure or a cushion using worn tires or polyurethane foam. The safety guard on a concrete structure may protect roadway facilities using a simple construction at low cost, however it does not function to absorb vehicular impacts at all. As a result, it presents a serious roadway hazard to vehicles. In the case of the cushion safety guard, it is good at absorbing impact energy, however it returns the impact energy as repulsive power which sends the impacting vehicle back into traffic at a steep angle. This may cause secondary collisions on the roadway with other vehicles.

To overcome these problems of the conventional safety guard, various vehicular impact absorbing apparatuseshave been proposed, for example, in Korean Patent No. 0348707, U.S. Pat. No. 5,868,521, and PCT International Publication No. WO 00/52267.

Korean Patent No. 0348707 discloses a vehicular impact absorbing apparatus having an array of rubber barrels filled with a cushioning material. The rubber barrels are supported by a steel plates buried in each barrel and slidably mounted on a single centered rail. The barrels following the front barrel are provided at an inner side thereof with a wave-shaped steel plate. The rear end of barrel array is fixed to a roadway obstruction by anchor bolts. In a crash, the barrels are retracted along the rail and compressively transformed to absorb the kinetic energy of an impacting vehicle. The wave-shaped steel plate restrains the repulsive force resulting from the impact energy.

However, since the cushioning simply depends on the physical transformation of the cushioning material, the cushioning effect may be affected by the characteristics of the cushioning material, and it is difficult to fully cushion several tons of kinetic energy.

Although this may be overcome by extending the length of the barrel array, it may be limited by conditions of the roadway. Further, since the barrel array is fixed to the concrete wall, it can not be installed at the location where concrete walls do not exist, such as the ends of median dividers and the front of simple branched roads.

U.S. Pat. No. 5,868,521 discloses a highway crash cushion including an array of diaphragms each of which has a guide slidably mounted on a single central guide rail, a plurality of energy absorbing elements disposed between the diaphragms, and an array of fender panels extending alongside the diaphragms. In axial collapse, the diaphragms move closer to one another, the fender panels telescope over one another, and the energy absorbing elements are compressed. Since this crash cushion also absorbs the kinetic energy of an impacting vehicle as the crash cushion collapses axially, it may require a considerable axial length of the crash cushion in order to absorb several hundred tons of kinetic energy. Also, it is costly to repair and rebuild the energy absorbing elements following a collision.

PCT Publication WO 00/52267 discloses a crash cushion formed by a pipe rack frame that retains a number of axially disposed cushion barrels. The pipe frame is provided with a slider which constrains the barrels. The barrels are crushed to absorb a vehicular impact. Using such a crash cushion, it is also difficult to fully absorb several tons of impact energy.

SUMMARY OF THE INVENTION

Accordingly, the present invention has been made keeping the above problems occurring in the prior art in mind. An object of the present invention is to provide a vehicular impact absorbing apparatus which can effectively absorb the kinetic energy of an impacting vehicle.

Another object of the present invention is to provide a vehicular impact absorbing apparatus which is free from the restraint of installation due to roadway conditions.

A further object of the present invention is to provide a vehicular impact absorbing apparatus which prevents an impacting vehicle from springing back due to the repulsive power thereof.

A further object of the present invention is to provide a vehicular impact absorbing apparatus which utilizes discarded resources as a cushion element thereby minimizing installation costs.

A further object of the present invention is to provide a vehicular impact absorbing apparatus which can be quickly rebuilt following a collision thereby reducing the cost to repair and rebuild the apparatus.

In order to accomplish the above objects, the present invention resides in a vehicular impact absorbing apparatus, which comprises: a tubular guide rail having a guide slit longitudinally formed at the upper part of the guide rail, the guide rail being fixed to the ground; a plurality of sliders movably mounted in the guide rail at predetermined intervals, the upper part of each slider being laid on the upper part of the guide rail through the guide slit; a plurality of cushion units mounted on the upper part of each slider, each cushion unit being elastically deformed by vehicular impacts to retract along the guide rail; a group of cushion pins mounted across the guide rail at predetermined intervals located between the sliders, the cushion pins being broken serially by the slider which is retracting rearward; a stopper installed around the rear end of the guide rail for stopping the retracting cushion units; and a side fence retractably mounted alongside the cushion units, the one end of the side fence being fixed to the stopper and the other to the front cushion unit.

In accordance with a preferred feature of this invention, the cushion unit includes a base plate mounted on the top portion of the slider, the base plate having supports fixed thereto and vertically extending along the side portion of the cushion unit; a cushion element loaded onto the supports of the base plate with a part of the cushion element protruding from the front and rear side of the base plate; and a holding cover coupled to the base plate and the top portion of the support, surrounding both sides of the cushion element. For example, the cushion element includes a stack of worn tires laid around the support.

In accordance with a preferred feature of this invention, the guide rail is formed with a plurality of fastening holes for receiving the cushion pins, and the fastening holesare formed in two rows such that the holes in each row cross each other.

In accordance with a preferred feature of this invention, the apparatus further comprises an outer cover for enclosing the components of the apparatus, the outer cover including a plurality of middle covers coupled to each cushion unit for covering the cushion units, a front cover coupled to the foremost middle cover for covering the front portion of the foremost cushion unit, and a rear cover for covering the stopper, the covers being coupled to telescope over one another.

Using the vehicular impact absorbing apparatus according to the present invention, an effective absorption of the kinetic energy of an impacting vehicle is possible through an elastic deformation of the cushion units and successive shear of the cushion pins.

Further, since the broken cushion pins interfere with the sliders after the sliders pass through the cushion pins, it is possible to prevent spring back of the cushion elements due to the repulsive power thereof and to stop the movement of the impacting vehicle. This contributes to a protection of the impacting vehicle againsta secondary collision with another vehicle.

Furthermore, since the amount of compressive deformation of the cushion elements is increased proceeding rearward, successive cushion and deceleration of the vehicular impact is possible, thereby absorbing the minute impact energy and minimizing the effect of the impact on vehicle passengers.

In addition, since the cushion units are elastically deformed as they move along the guide rails, the cushion units can be reused and only a simple replacing operation of the broken cushion pins is required. This contributes to reduction in maintenance and repair costs.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

This invention will be described in further detail by way of exemplary embodiments with reference to the accompanying drawings.

Figure 1:
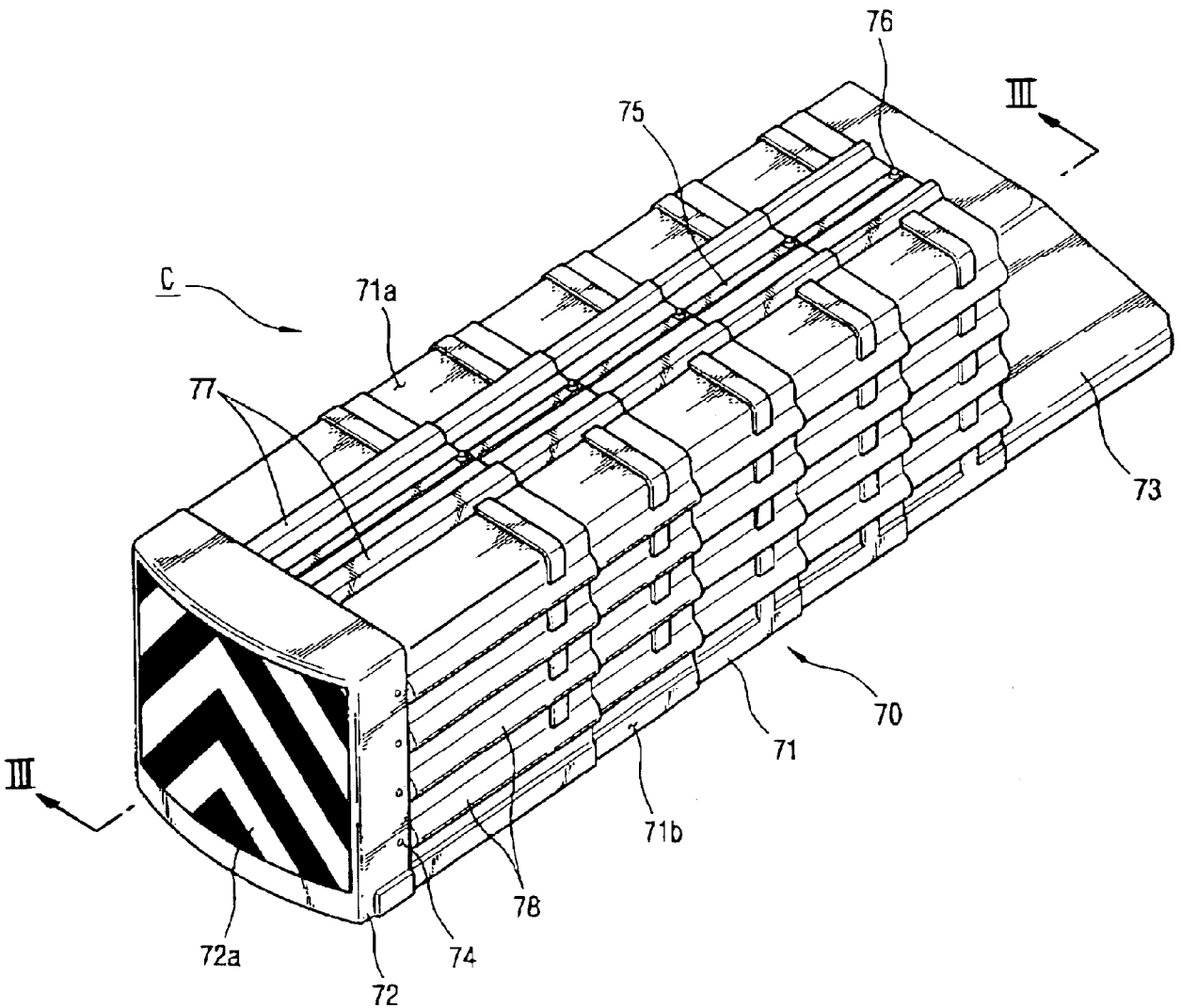
FIG. 1 is a perspective view of a vehicular impact absorbing apparatus according to the present invention.

Referring to FIG. 1, there is shown a safety guard including a vehicular impact absorbing apparatus according to the present invention. The impact absorbing apparatus is covered with a cover assembly 70, which includes a front cover 72, a middle cover 71, and a rear cover 73. The covers 71, 72 and 73 are adapted to telescope over one another in an axial collapse. The details of the cover assembly 70 will be described hereinafter with reference to FIG. 8.

Figure 2:
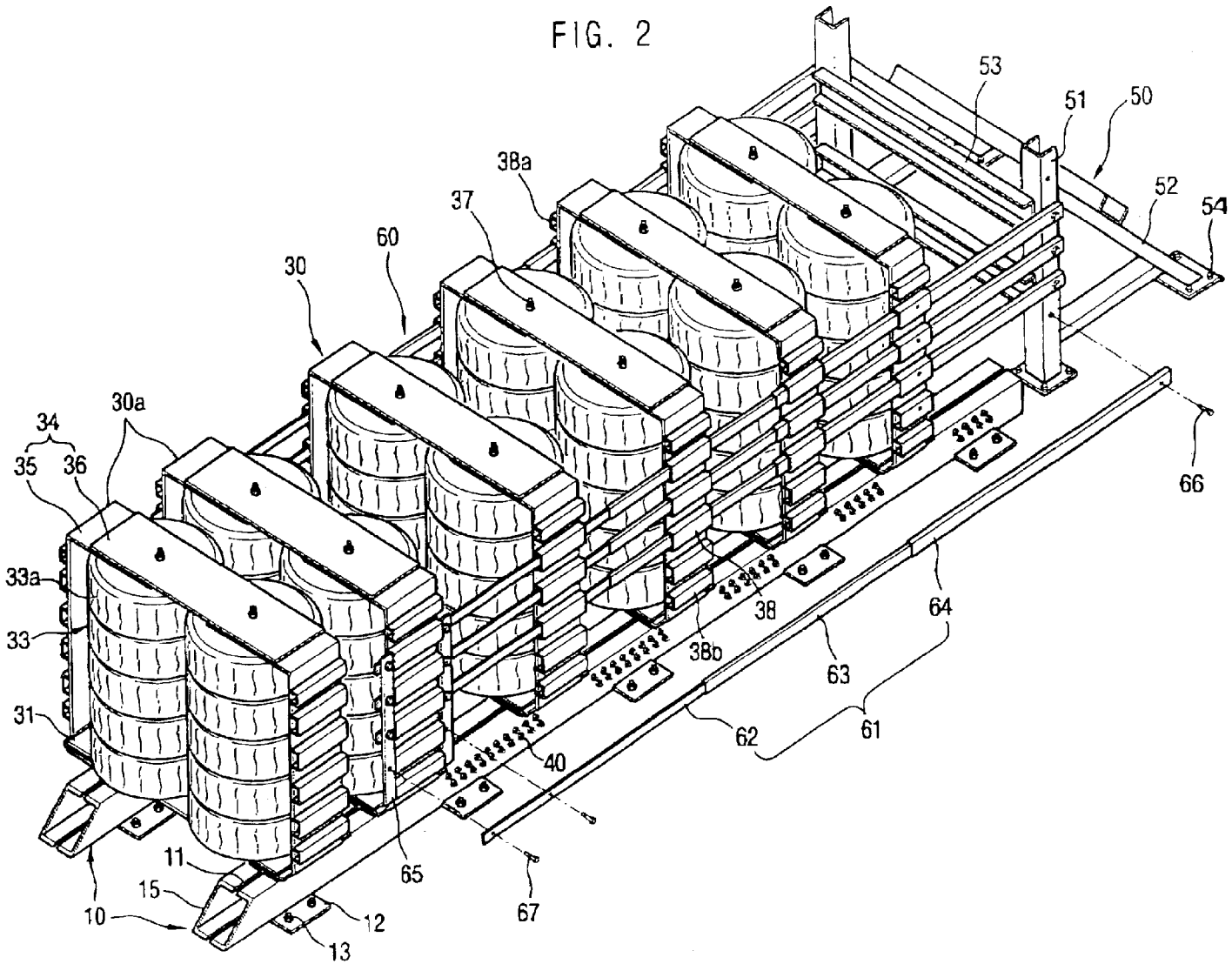
FIG. 2 is a partial exploded perspective view of the vehicular impact absorbing apparatus shown in FIG. 1, with its cover removed from the apparatus.
Figure 4:
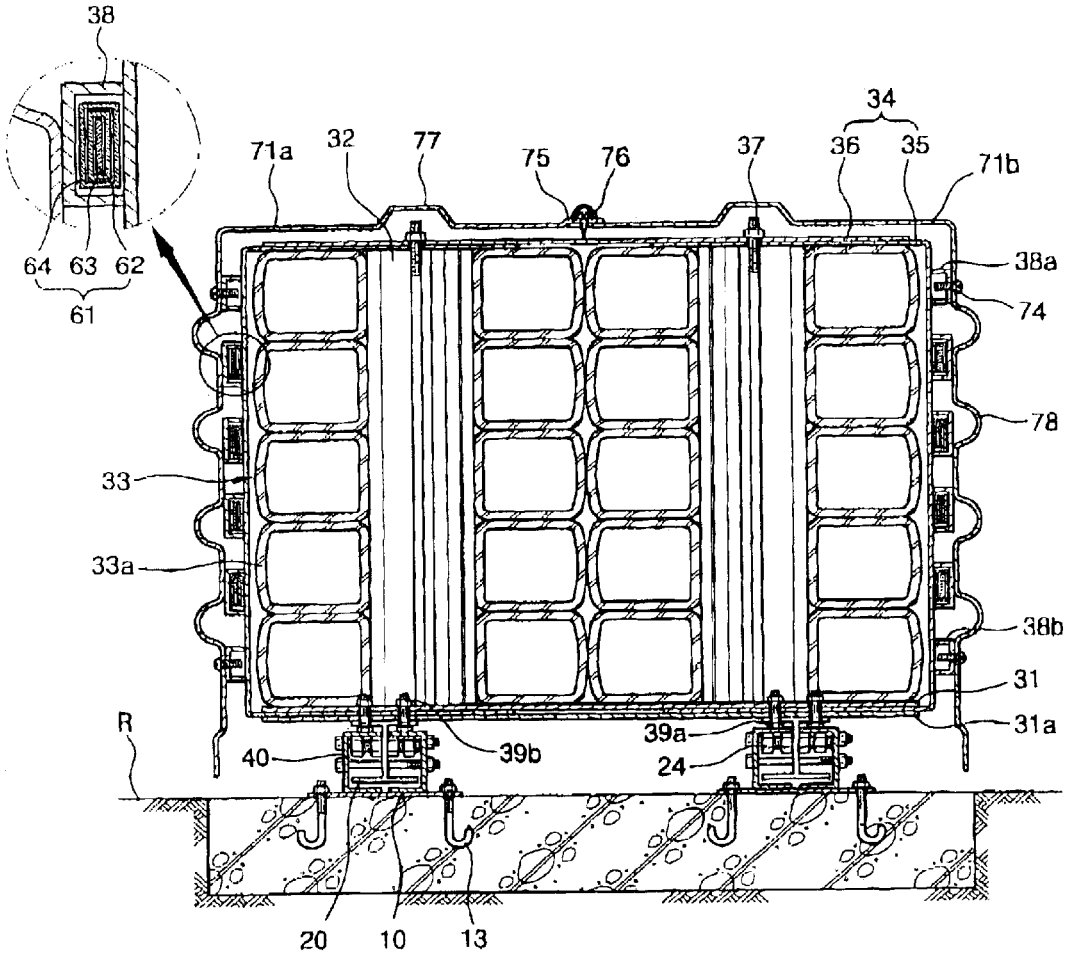
FIG. 4 is a cross-sectional view taken along line IV—IV of FIG. 3.

As shown in FIGS. 2 and 4, the vehicular impact absorbing apparatus includes a plurality of cushion units 30 arranged in the form of an array. The cushion units 30 are to absorb vehicular impacts in a more effective way. Each cushion unit 30 has a slider 20 movably mounted onto a guide rail 10, which is fixed to the ground. The guide rail 10 is provided with a group of cushion pins 40 fixed across the guide rail 10. Each group of cushion pins 40 is disposed at a predetermined interval along the guide rail 10. The apparatus further includes a stopper 50 provided at the rear end of the guide rail 10 and a pair of side fences 60 provided alongside the cushion units 30. The side fence 60 is comprised of a plurality of retractable bars 61.

The guide rail 10 is formed by a hollow rectangular metal tube and is provided at its upper center surface with a guide slit 11 formed along the length thereof. Also, the guide rail 10 has a plurality of mounting plates 12 provided along both sides thereof at intervals so as to fix the guide rail 10 on the ground "R" by anchor bolts 13.

Further, the guide rail 10 is formed with a plurality of fastening holes 14 for receiving the cushion pins 40. The fastening holes 14 are formed in two rows such that the holes 14 in each row cross each other. This will allow the cushion pins 40 to be densely disposed within the designated section of the guide rail 10.

Preferably, each cushion pin 40 consists of a bolt 41 and a nut 42. The number of cushion pins 40 as well as their diameter is determined by considering the amount of expected impact energy and allowable shearing stress of the material.

Figure 5:
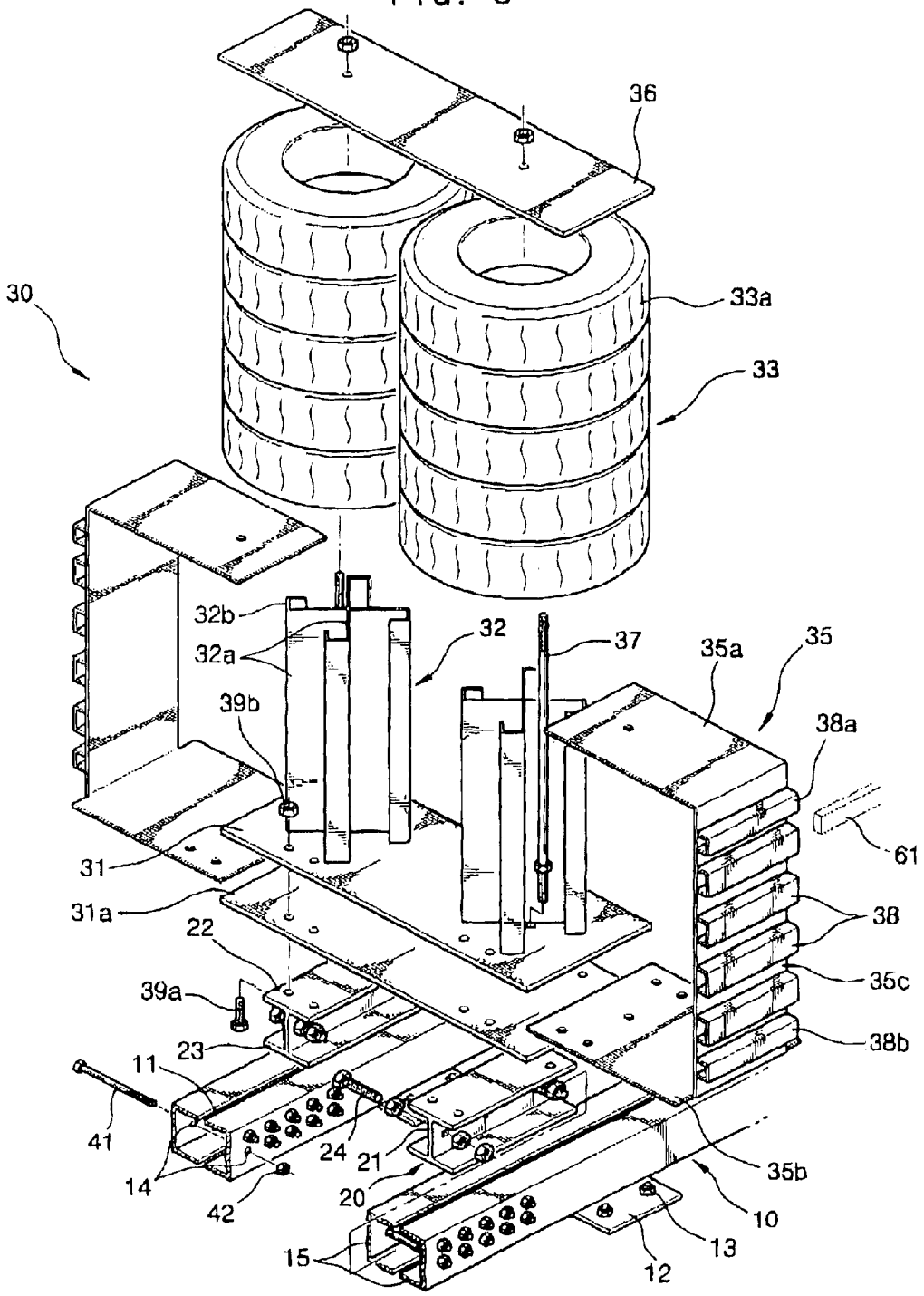
FIG. 5 is an exploded perspective view of a slide cushion unit extracted from the apparatus of the present invention.

Preferably, as shown in detail in FIG. 5, the guide rail 10 is manufactured from a pair of channel-type steel frames 15 in such a way that the frames 15 face each other with a desired space and are fixed to the mounting plates 12 by a welding process.

Preferably, as shown in FIG. 4, the guide rail 10 is provided in parallel pairs having a desired interval, so that they stably support the cushion units 30 thereon and double the amount of cushion pins 40 being provided in the guide rail 10. With this, the cushion effect is increased enough to reduce the size of the cushion unit array to almost half of its longitudinal length, as compared to the one without the cushion pins 40.

Inside the guide rail 10, the slider 20 is movably mounted at predetermined intervals. As apparent in FIGS. 5 to 7, the slider 20 is formed into an I-beam member having a web 21 and a pair of flanges 22, 23 formed at upper and lower ends of the web 21. The web 21 of the slider 20 is inserted into the guide slit 11 of the rail 10, with the upper flange 22 being placed over the outer side of the guide rail 10.

Figure 6:
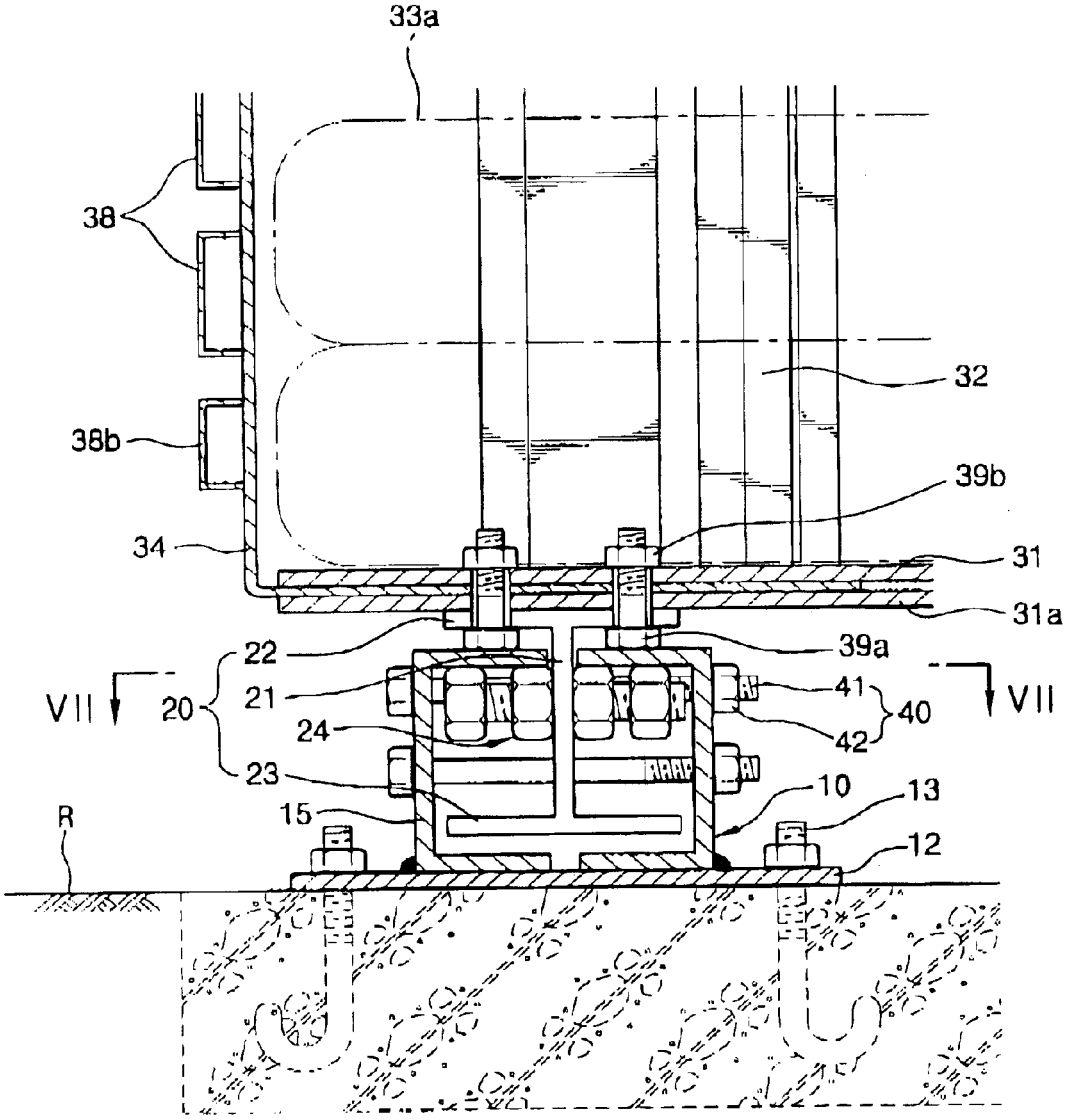
FIG. 6 is a partial enlarged front view showing the assembled state of the slide cushion unit shown in FIG. 5.
Figure 7:
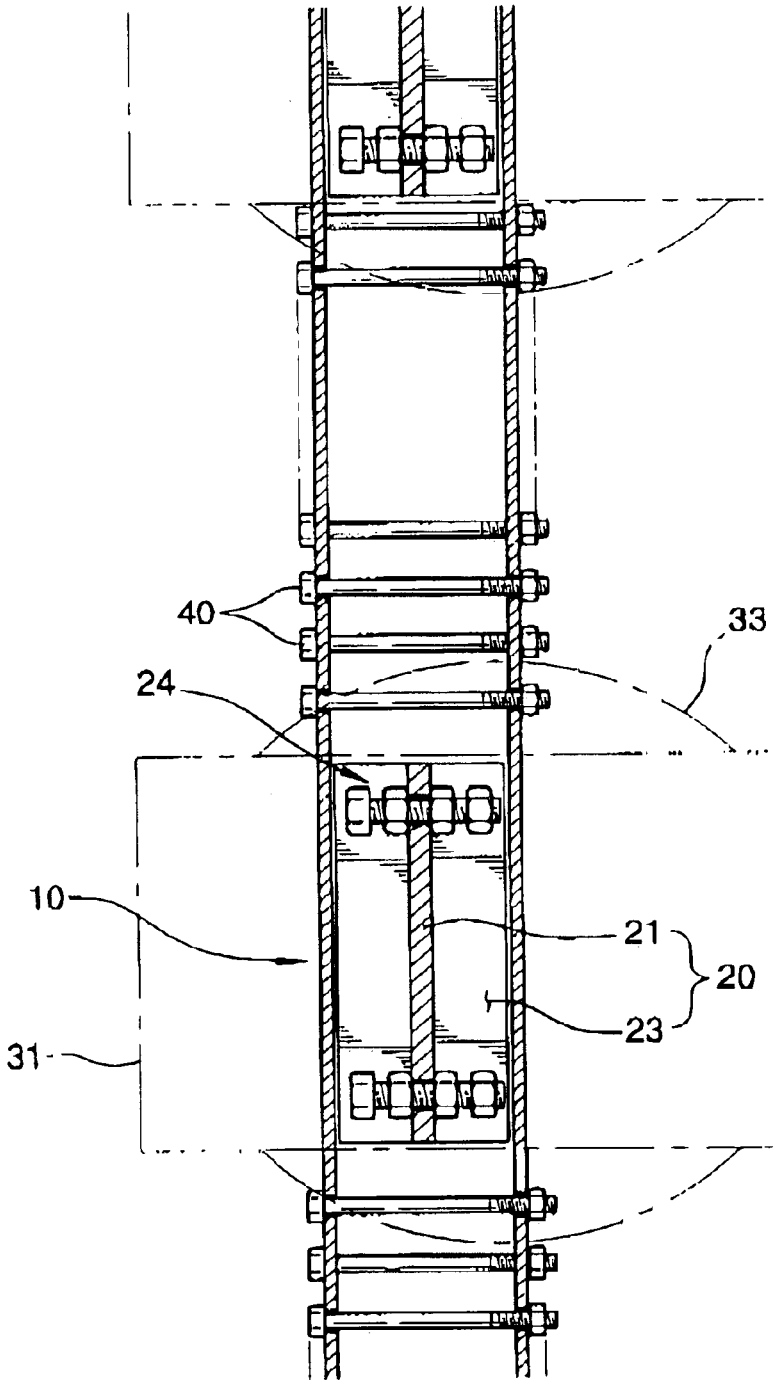
FIG. 7 is a partial cross-sectional view taken along line VII—VII of FIG. 6.

Referring to FIGS. 6 and 7, the slider 20 is provided at its front and rear portion with a pair of anti-shaking members 24 which pass through the web 21 of the slider 20. The top portion of each anti-shaking member 24 abuts against the inner top surface of the guide rail 10.

The anti-shaking member 24 is preferably made from a bolt and nut. However, the anti-shaking member 24 may have other forms, for example, a pin, a roller and so on.

The anti-shaking member 24 prevents up-and-down movement of the slider 20 when a vehicular impact is applied to the cushion unit 30.

Referring again to FIG. 6, there is shown a pair of bolt heads 39*a* placed between the lower sides of the upper flange 22 of the slider 20 and the upper surface of the guide rail 10. The bolt 39 couples the slider 20 to the cushion unit 30.

The cushion unit 30 includes a base plate 31 mounted on the top portion of the sliders 20, a pair of supports 32 fixed to the base plate 31 and vertically extending along the side portion of the cushion unit 30, a cushion element 33 loaded onto the base plate 31, a holding cover 34 for holding the cushion element 33 in the base plate 31.

The base plate 31 is formed into a rectangular steel plate, with its corner portion being laid and fixed to the upper flange 22 of the slider 20 by bolts 39*a* and nuts 39*b* (See FIG. 5). The axial length of the base plate 31 is determined such that a part of the cushion element 33 protrudes from both edges of the base plate 31.

Preferably, a reinforcing plate 31*a* is interposed between the lower side of the base plate 31 and the upper flange 22 of two sliders 20. Thus, the bolt head 39*a* fixed to the upper flange 22 of slider 20 can be in contact with the upper surface of the guide rail 10.

A pair of vertical supports 32 is placed on both sides of the base plate 31, for supporting the cushion element 33. The support 32 is formed by X-shaped crossing plates 32*a* having a desired longitudinal length. The end of each plate 32*a* is formed with a bending portion 32*b*, for reinforcing the strength thereof. The support 32 may have other appropriate forms to receive the cushion element 33.

The cushion element 33 is preferably formed by a stack of worn tires 33*a* placed around the support 32. The cushion element 33 can be made of a resilient material such as rubber, polyurethane and the like. However, worn tire prevails over other materials because it has excellent elasticity and is a useful recyclable material.

The holding cover 34 is comprised of a pair of channel-shaped unit covers 35 and a coupling plate 36. The holding cover 34 is fixed to both sides of the base plate 31 such that the cover 34 partly surrounds the cushion element 33 while a part of the front and rear portion of the cushion element protrude therefrom. The coupling plate 36 connects an upper portion 35*a* of the unit cover 35 to the opposing coupling plate. The lower portion 35*b* of each unit cover 35 is placed between the base plate 31 and the reinforcing plate 31*a* to be joined thereto by the bolt 39*a* and nut 39*b*. Also, the upper portion 35*a* of each unit cover 35 is coupled to the coupling plate 36 and then the base plate 31 by a stay bolt 37, which is passed through one compartment of each support 32.

As can be seen in FIG. 5, one end of the stay bolt 37 is fixed to the base plate 31 and the other end to the coupling plate 36. With this arrangement, the cushion element 33 can be stably supported by the holding cover 34. Instead of the stay bolt 37 which crosses the support 32, a short bolt can be integrally formed at the top and bottom portions of the support 32 by welding.

Particularly, the upper portion 35*a* of each unit cover 35 is sized such that its width is shorter than that of the lower portion 35*b* thereof, so that the exposed area of the cushion element 33 around the upper portion 35*a* of unit cover 35 is is sized such that its width is shorter than that of the lower portion 35*b* thereof, so that the exposed area of the cushion element 33 around the upper portion 35*a* of unit cover 35 is larger than that of the lower portion 35*b*. This allows the cushion element 33 to have a margin for absorbing more impacts when all of the cushion units 30 are compressed to face each other by a vehicular impact.

At the side portion 35*c* of the unit holding cover 35, a plurality of guide tunnels 38 are horizontally provided to movably insert a side bar 61 of the side fence 60, which will be described hereinafter. Further, the upper and lower outlines of the guide tunnels 38, and brackets 38*a*, 38*b* are provided to support the outer cover 70.

The upper guide tunnels 38 and brackets 38*a*, 38*b* can be made in the form of a separate unit and then fixed to the side portion 35*c* of the unit cover 35 by welding. Also, they can be formed into a corrugated integral assembly and welded to the side portion 35*c*.

As shown in FIG. 7, a group of cushion pins 40 are mounted to the guide rail 10 such that they are disposed at a predetermined interval alongside the guide rail 10. The cushion pins 40 are arranged in two rows, corresponding to the fastening holes 14 formed in the guide rail 10. As mentioned before, the cushion pins 40 in each row are placed to cross each other. This allows the cushion pins 40 to be densely disposed in the designated section of the guide rail 10. Every group of cushion pins 40 serially cushion vehicular impacts as the cushion units 30 collapse axially.

Figure 3:
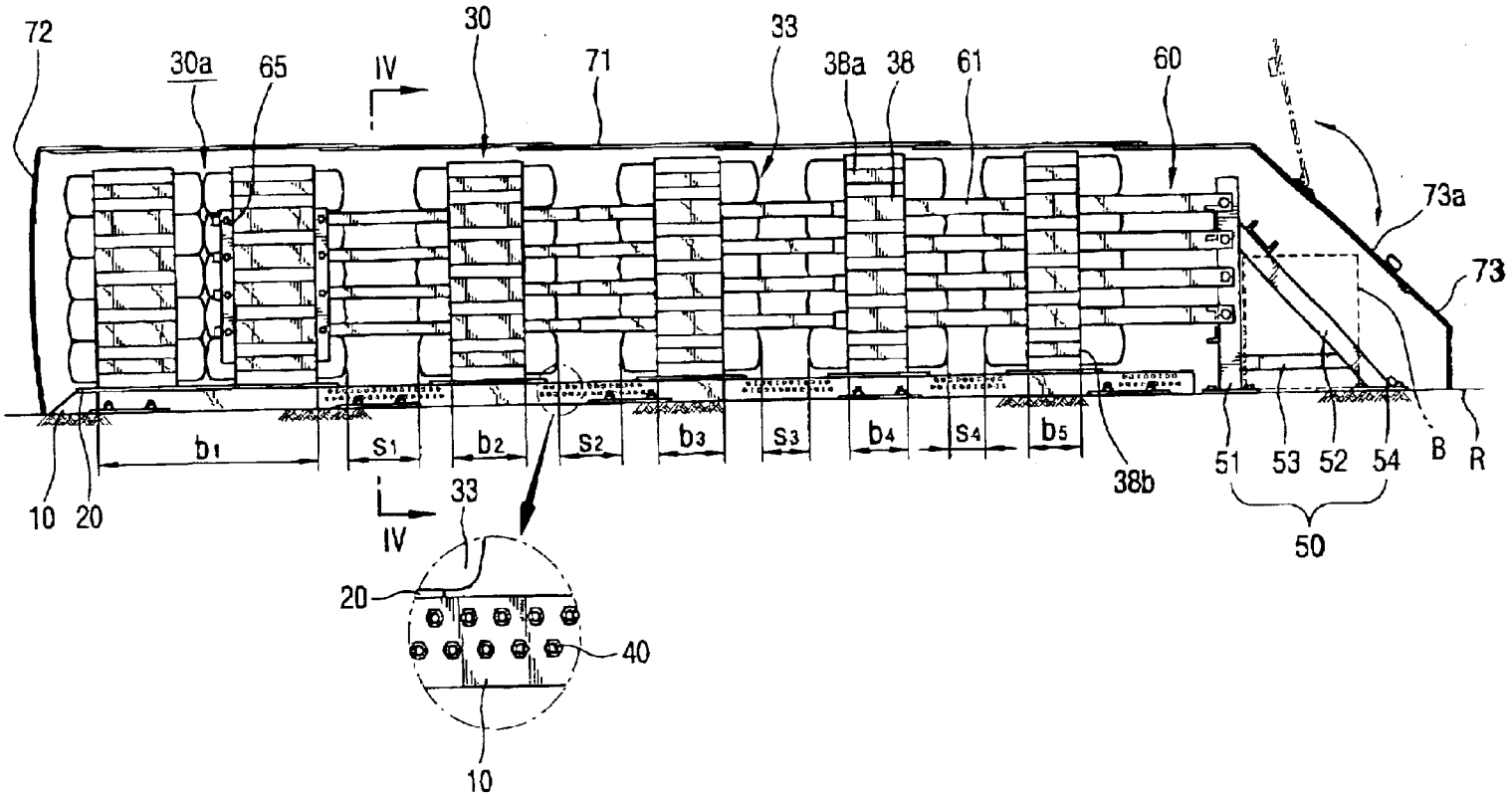
FIG. 3 is a cross-sectional view taken along line III—III of FIG. 1.

Referring to FIG. 3, the widths $b_1$, $b_2$, . . . $b_5$ of each holding cover 34 are determined such that they are gradually decreased proceeding in the rearward direction ($b_1>b_2>b_3>b_4>b_5$). This provides for a sufficient installing space for a group of cushion pins 40 and reduced total length of the cushion unit array. As a result, the safety guard can be adequately installed in a limited area such as a 'safety zone' which is in front of a roadway branch, for example.

Accordingly, the size of the exposed portions of each cushion element 33 is increased as they proceed in the rearward direction, which allows cushion element 33 to have an increased amount of elastic deformation. This contributes to a smooth absorption of the kinetic energy of an impacting vehicle and minimizes shock for the passenger.

Also, because the kinetic energy of an impacting vehicle is decreased as it proceeds in the rearward direction, it has been determined that the spaces $S_1$, $S_2$, . . . $S_4$ between each cushion unit 30 may gradually decrease as they proceed in the rearward direction ($S_1>S_2>S_3>S_4$), and the number of the cushion pins 40 may decrease as well. As a result, the total length of the cushion unit array can be reduced.

On the other hand, the front cushion unit 30*a* is comprised of two cushion units 30, incorporated into a unit body. This is because the front cushion unit 30*a* will receive the maximum kinetic energy at the initial vehicular impact. This allows for a stable resistance to the initial impact and a smooth intrusion into the subsequent cushion unit.

Behind the last cushion unit, the stopper 50 is provided to limit the rearward movement of the cushion unit array. The stopper 50 is preferably formed into a truss type steel structure. As shown in FIG. 2, the stopper 50 includes a pair of vertical posts 51 which are supported by a slant support bar 52, respectively. A pair of connecting bars 53 are horizontally joined between the support bars 52. The post 51 and the slant support bar 52 are fixed to the ground by an anchor bolt 54.

Referring again to FIG. 2, the side fence 60 is comprised of a plurality of side bars 61 horizontally disposed between the front cushion unit 30*a* and the stopper 50. The side fence 60 is provided to cushion a lateral vehicular impact, which prevents the impacting vehicle from moving into the region between the cushion units 30 and, acting like a guard rail, redirects the impacting vehicle without sending it back into traffic.

In an axial vehicular impact, the side bars 61 should be compressed alongside the cushion units 30 moving rearward. To this end, each side bar 61 consists of three separate bars 62, 63 and 64, coupled to one another in a telescopic form. The side bar 61 is inserted into the guide tunnels 38 provided at each side portion of the holding covers 34. Each of the front separate bars 62 is fixed to a vertical coupling bar 65 provided at both sides of the guide tunnel 38 of the front cushion unit 30*a*, by a bolt 67. Further, each of the rear separate bars 64 is fixed to the vertical post 51 of the stopper 50 by a bolt 66.

In such a side bar 61, the length of the rear separate bar 64 corresponds to the length of the cushion unit assembly, from the post 52 of the stopper to the front cushion unit 30, that is fully compressed by an axial vehicular impact. This will prevent the side bar 61 from intruding into the impacting vehicle.

Figure 8:
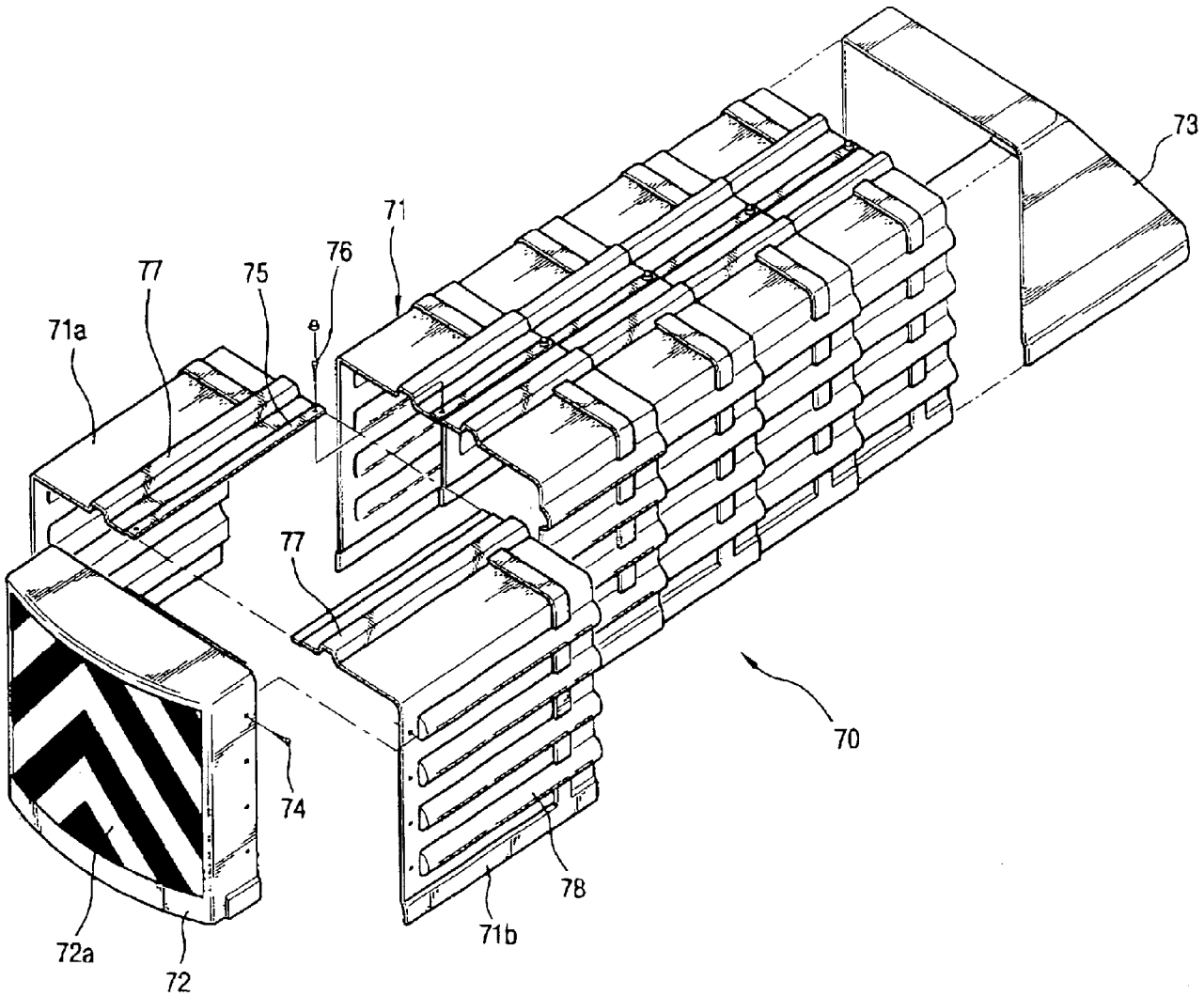
FIG. 8 is an exploded perspective view of a cover assembly of the vehicular impact absorbing apparatus of FIG. 1.

Referring to FIG. 8, the vehicular impact absorbing apparatus of this invention preferably includes an outer cover 70, which can be compressed simultaneously with the cushion units 30 and allows for good appearance of the safety guard. The outer cover 70 consists of a plurality of middle covers 71 for covering the cushion unit array, a front cover 72, and a rear cover 73 for covering the stopper 50. These covers are coupled to telescope over one another, so that each unit of middle cover 71 can be overlapped successively and retracted to the rearward middle cover. To this end, each of the middle covers 71 is fixed to the bracket 38*a* of the corresponding cushion unit 30 by a screw 74, and the front cover 72 is fixed to the front middle cover. The rear cover 73 is also fixed to the rearward middle cover by screws. In this embodiment, the middle cover 71 is horizontally divided into at least two panels 71*a*, 71*b* which acts as a fender panel. To couple the divided panels to each other, one of the panels 71*a*, 71*b* is provided at the top end part thereof with a rise portion 75, on which the other top end part is fitted. The panels 71*a*, 71*b* are coupled to each other by screws 76.

Further, a guide bead 77 is outwardly formed at the upper portion of the middle cover 71 to secure a space for the top end of the stay bolt 37. Also, a plurality of reinforcing beads 78 are outwardly formed at each side of the middle cover 71.

The surface of the front cover 72 is attached with a safety sign 72*a*, preferably made of a light-reflective material. The rear cover 73 is provided at its center portion with a door 73*a* for communicating with a box "B" placed on the space of the stopper 50. The box "B" receives for example sand bags and the like.

The outer cover or cover assembly 70 may be manufactured from high strength synthetic resins, such as fiber glass reinforced plastics (FRP).

The operation of the above vehicular impact absorbing apparatus will be described with reference to FIG. 9A to FIG. 10B. The vehicular impact absorbing apparatus of this invention is installed on a site as shown in FIG. 3. The cushion units 30 are positioned maintaining a predetermined space $S_1$, $S_2$, $S_3$ and $S_4$ relative to each other. The side bar 61 and the outer cover 70 are at their fully extended state.

Figure 9A:
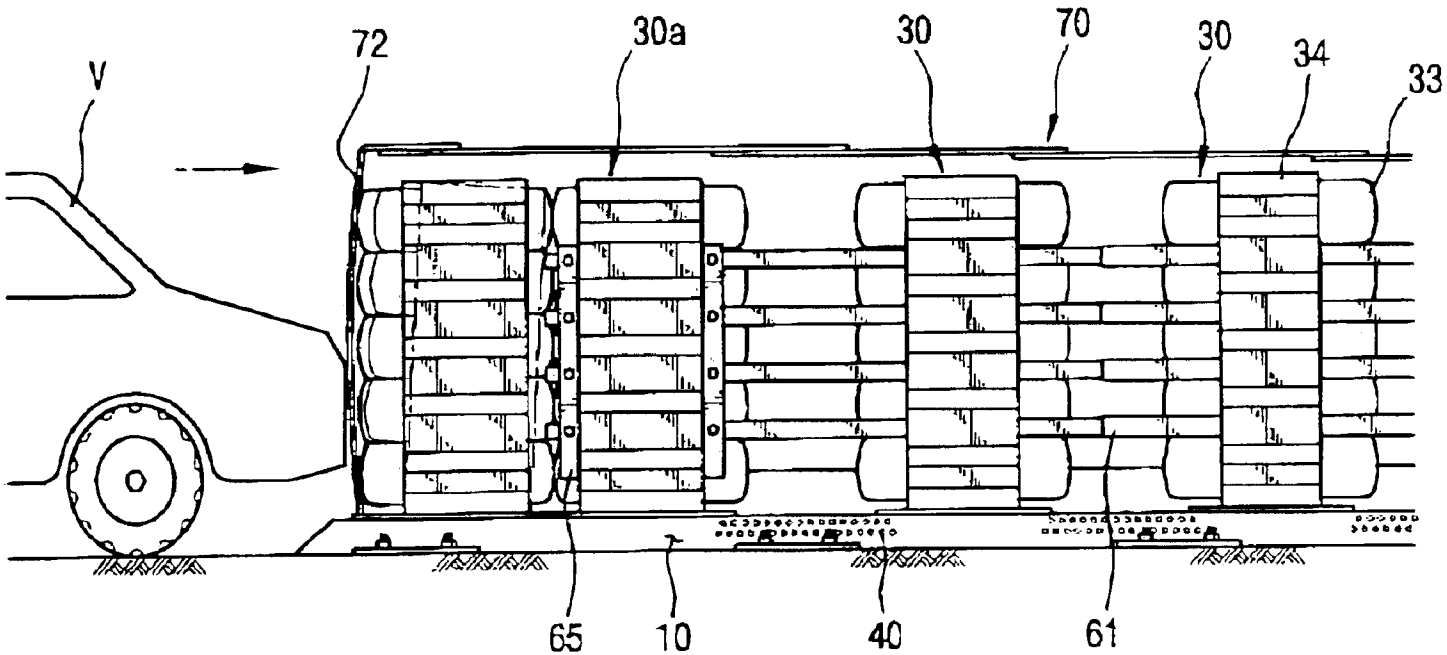
FIGS. 9A to 9C are side views schematically illustrating the cushioning operation of the apparatus according to the present invention.

In this state, when the front of the cover assembly 70 collides with a vehicle "V", as shown in FIG. 9A, the foremost cushion unit 30*a* is tilted rearward (shown as imaginary lines) and the exposed portion of the cushion element 33 is elastically deformed to absorb the initial vehicular impact, which is considered the largest kinetic energy of the impact.

At the same time, as the foremost cushion unit 30*a* moves rearward by the remaining kinetic energy, the sliders 20 joined to the bottom portion of the cushion unit 30*a* begin to move quickly in the rearward direction.

Figure 10A:
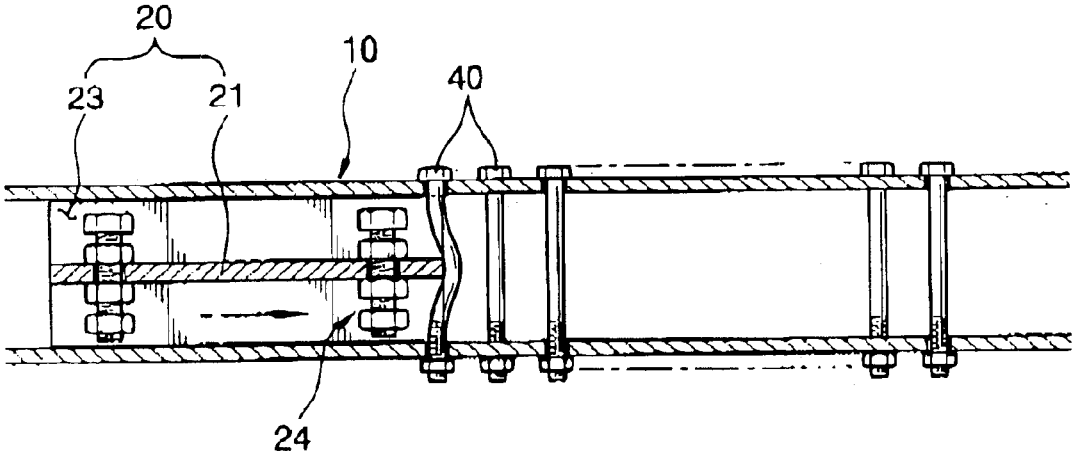
FIGS. 10A and 10B are partial plan sectional views showing the energy absorbing operation of the slide cushion unit of this invention.
Figure 10B:
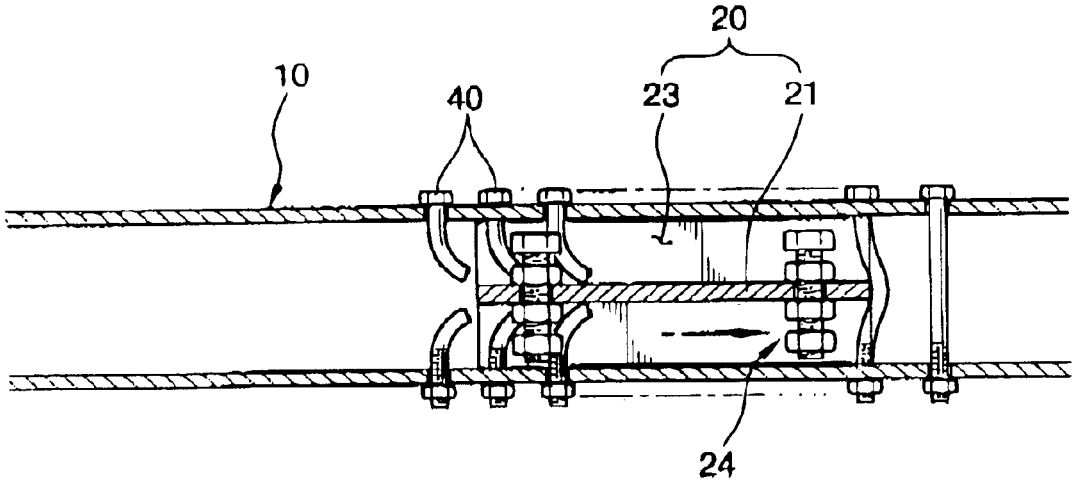

As the sliders 20 move rearward along the guide rail 10, the cushion pins 40 mounted over the designated space between the foremost cushion unit 30*a* and the subsequent cushion unit 30 will be broken one by one, by colliding with the web 21 of the slider 20, as shown in FIGS. 10A and 10B.

The cushion pins 40 will resist against the striking force of the slider 20 due to its impact strength, and finally be broken. This process contributes to a smooth absorption operation of the present invention. Furthermore, since the cushion pins 40 are mounted in a group at every location between the subsequent cushion units 30, the kinetic energy of the impacting vehicle will gradually decrease due to breaking of the cushion pins 40.

Thus, kinetic energy can be absorbed by a group of cushion pins 40 and the speed of the impacting vehicle will decrease.

Figure 9B:
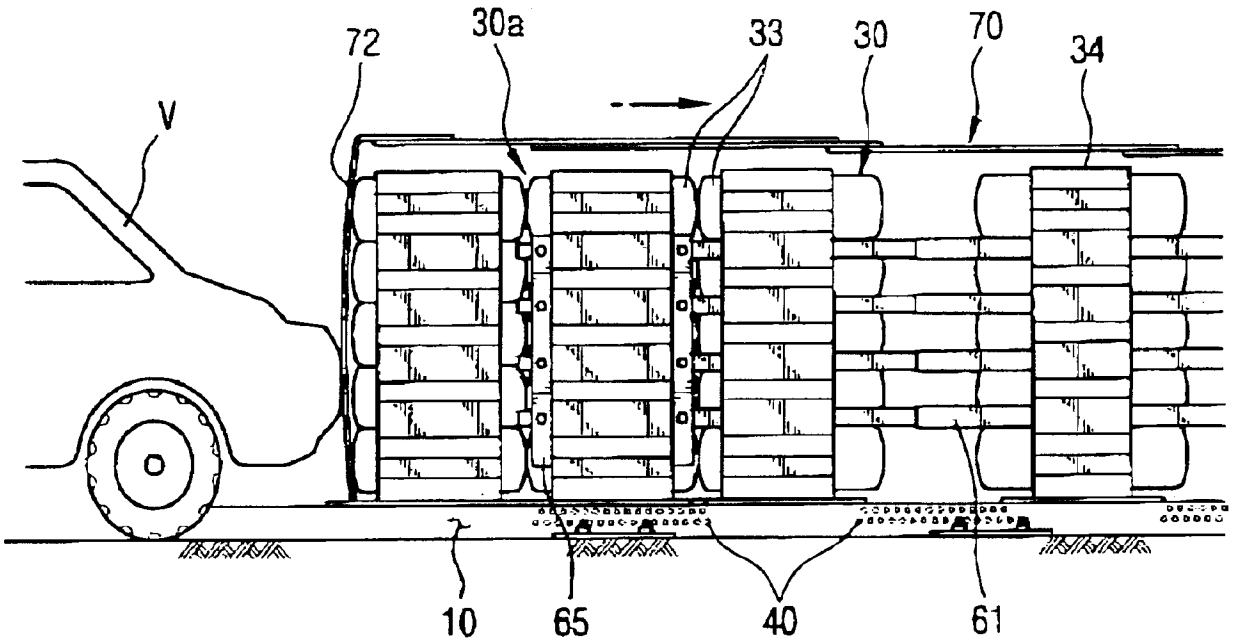

As shown in FIG. 9*b*, as the foremost cushion unit 30*a* moves to the subsequent cushion unit 30 while breaking the cushion pins 40 located at the front area, the exposed cushion element 33 of the cushion unit 30 is also elastically deformed by the successive vehicular impact. This cushion unit 30 also begins to move quickly in the rearward direction along the guide rail 10. Accordingly, the cushion pins 40 mounted over the designated space between the subsequent cushion units 30 will be broken serially with a resistance against the strike of the second slider. With this, the kinetic energy of the impacting vehicle and the speed of the impacting vehicle is further decreased.

Figure 9C:
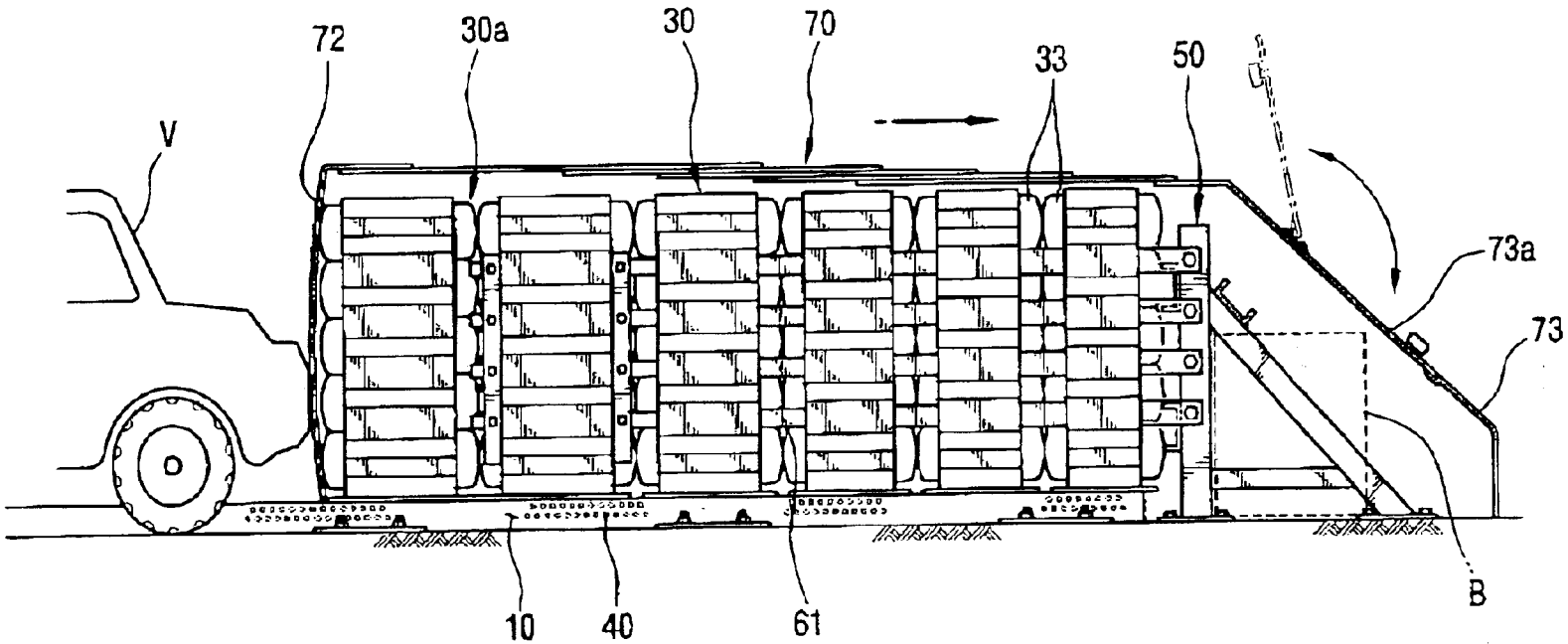

Lastly, as shown in FIG. 9C, as all the cushion units 30 move closer to the rear end portion of the cushion unit array, the movement of cushion units 30 are restrained by the stopper 50 with each cushion unit 30 being closer to one another in the elastically deformed state. Thus, the kinetic energy of the impacting vehicle is eliminated and the impacting vehicle is stopped.

In this operation, since the widths $b_1$, $b_2$, . . . $b_5$ of each holding cover 34 of the cushion units 30 are gradually decreased and the exposed portions of the cushion elements 33 are gradually increased as they proceed in the rearward direction, the amount of compress deformation of the cushion elements 33 increases as the kinetic energy of an impacting vehicle and the vehicle speed decrease, by successive cushioning and deceleration of the vehicular impact, thereby effectively absorbing the minute impact energy and minimizing the effect of the impact on the passenger.

Further, since the upper portion 35*a* of the unit holding cover 35 is shorter in width than the lower portion 35*b* thereof, and the exposed area of the cushion element 33 around the upper portion 35*a* is larger than that of the lower portion 35*b*, the cushion element 33 can be further compressed in the full retraction state of the cushion units 30, thereby absorbing a marginal impact energy.

Therefore, according this embodiment, the kinetic energy of the impacting vehicle can be nearly removed at the time all the cushion units 30 are moved to the rear end and are halted by the stopper 50. This will minimize injury of passengers and reduce damage of the impact absorbing apparatus itself as well as the impacting vehicle.

Particularly, since a group of cushion pins 40, disposed at short intervals within a designated section, are broken upon the strike of the slider 20, the broken cushion pins 40 interfere with the sliders 20 after passing through the cushion pins. Therefore, it is possible to prevent spring back of the cushion elements 33 due to the repulsive power thereof and to stop the impacting vehicle. This will protect the impacting vehicle against secondary collision with another vehicle.

Further, since the cushion units 30 are elastically deformed with the cushion elements 33 as they move along the guide rail 10, the cushion units 30 may be reused after replacing the broken cushion pins 40. This will contribute to saving costs for maintenance and repair.

Figure 11:
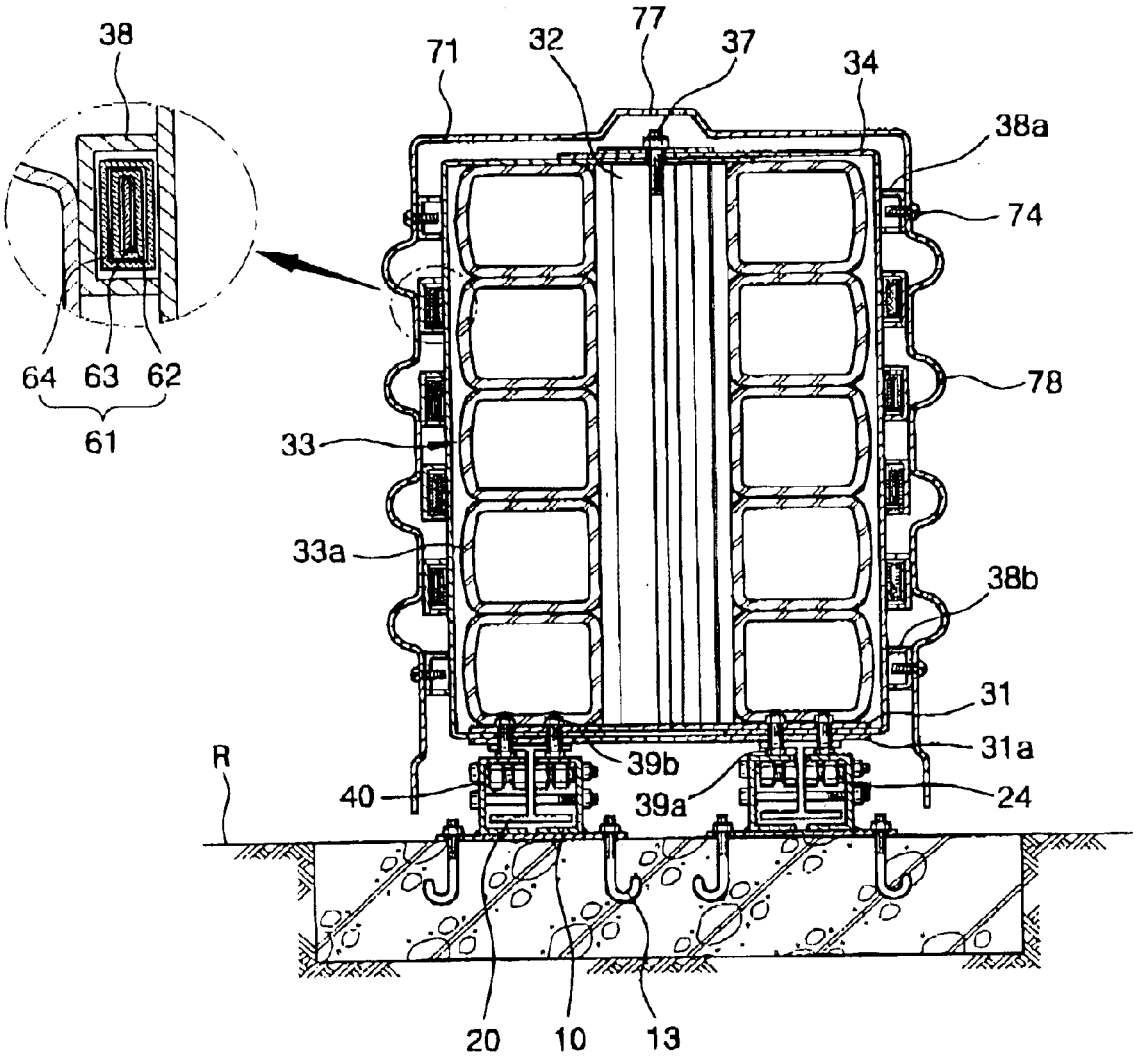
FIG. 11 is a cross-sectional view of a vehicular impact absorbing apparatus according to another embodiment of the present invention.

FIG. 11 shows a vehicular impact absorbing apparatus according to another embodiment of this invention.

In this embodiment, a cushion unit 30 has only one cushion element 33, which consists of a stack of worn tires like the previous embodiment. Thus, the width of the cushion units is narrower (almost half) than that of the previous embodiment. This arrangement can be applied to the location where the vehicle speed is restricted to a low speed and the kinetic energy of the impacting vehicle is relatively small. The rest of the components of this embodiment are the same as those of the first embodiment. Therefore, the detailed description will be omitted for brevity's sake, denoting the same reference numerals of the same components described in the first embodiment.

Figure 12A:
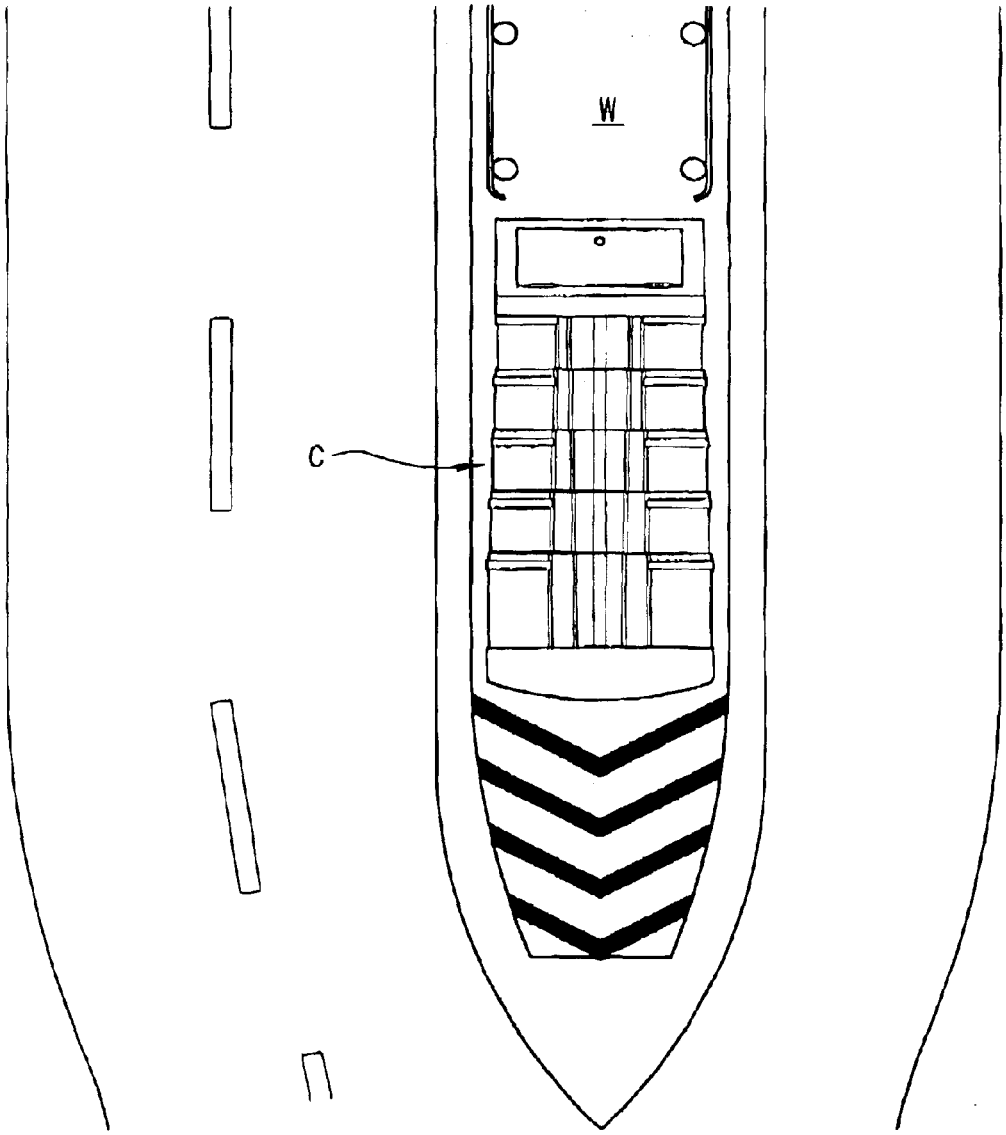
FIGS. 12A and 12B are plan views schematically showing an example of installation of the vehicular impact absorbing apparatus according to the present invention, each of which are installed in front of a branch road and at an end of a median divider, respectively.

FIG. 12A shows an example of an installation of the vehicular impact absorbing apparatus according to this invention. The safety guard "C" includes the above impact absorbing apparatus, which is installed in front of a branch road.

Figure 12B:
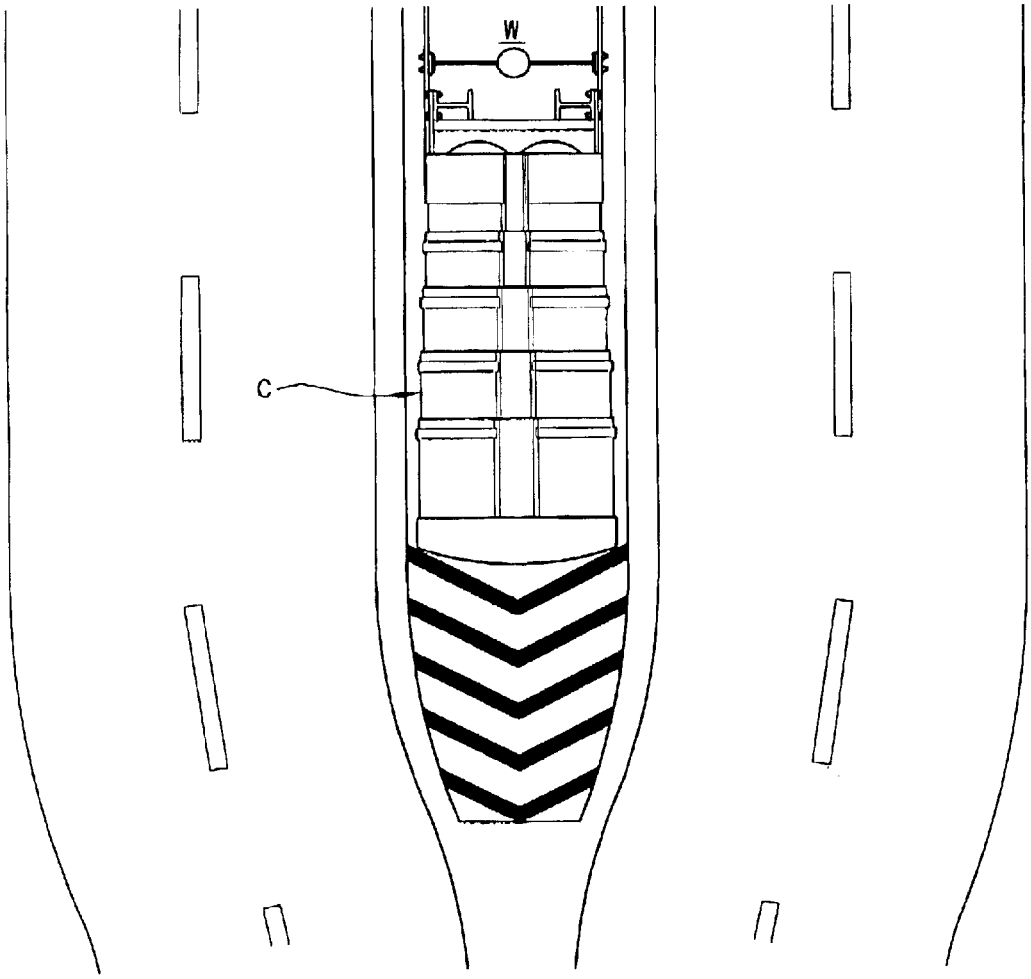

FIG. 12B shows the invention installed in front of an end of a median divider "W" , between both ends of the guide rails to constitute a part of the median divider "W". In this case, H-beams fixed adjacent to each end of the guide rails may be used as a stopper.

As described above, according to the vehicular impact absorbing apparatus of this invention, it is possible to effectively absorb kinetic energy of an impacting vehicle through elastic deformation of the cushion units and successive shear of the cushion pins.

Further, since the broken cushion pins interfere with the sliders after passing through the cushion pins, it is possible to prevent spring back of the cushion elements due to the repulsive power thereof and to stop the impacting vehicle, thereby protecting the impacting vehicle against secondary collision with another vehicle.

Furthermore, since the amount of compress deformation of the cushion elements is increased proceeding rearward, a successive cushion and deceleration of the vehicular impact is possible, thereby absorbing the minute impact energy and minimizing the effect of the impact on the passenger.

Further, since the cushion units are elastically deformed as they move along the guide rails, the cushion units can be reused and only replacement of the broken cushion pins is required. This contributes to reduction in maintenance and repair costs. In addition, the above allows for a reduced total length of the cushion unit array and the safety guard can be properly installed in a limited area.

Further, since worn tires are used as the cushion element of each cushion unit, the cost for manufacturing and repair can be reduced. After collision, the broken parts, for example the cushion pins, can be simply replaced, which contributes to saving costs for maintenance and repair.

Although preferred embodiments of the present invention have been described for illustrative purposes, those skilled in the art will appreciate that various modifications, additions and substitutions are possible, without departing from the scope and spirit of the invention as defined in the accompanying claims.

What is claimed is:

1. A vehicular impact absorbing apparatus, comprising:

tubular guide rail having a guide slit longitudinally formed at the upper part of the guide rail, the guide rail being fixed to the ground;

a plurality of sliders movably mounted in the guide rail at predetermined intervals, the upper part of each slider being laid on the upper part of the guide rail through the guide slit;

a plurality of cushion units mounted on the upper part of each slider, each cushion unit being elastically deformed by vehicular impact and retracting along the guide rail;

a group of cushion pins mounted across the guide rail at predetermined intervals between the sliders, the cushion pins being broken serially by the slider retracting rearward;

a stopper installed around the rear end of the guide rail for stopping the retraction of the plurality of cushion units; and a side fence retractably mounted alongside the cushion units, one end of the side fence being fixed to the stopper and the other end being fixed to a front cushion unit.

2. The apparatus as set forth in claim 1, wherein the cushion unit includes a base plate mounted on the top portion of the slider, the base plate having a support fixed thereto and vertically extended along the side portion of the cushion unit; a cushion element loaded onto the support of the base plate with a part of the cushion element protruding from the front and rear side of the base plate; and a holding cover coupled to the lower portion of the base plate and the top portion of the support, surrounding both sides of the cushion element.

3. The apparatus as set forth in claim 2, wherein the width of the base plate in each cushion unit gradually decreases with respect to the previous base plate proceeding in the rearward direction and wherein the protruding portions of the cushion element gradually increase as they proceed in the rearward direction.

4. The apparatus as set forth in claim 2, wherein the cushion element includes a stack of worn tires laid around the support.

5. The apparatus as set forth in claim 1, wherein the guide rail is formed with a plurality of fastening holes for receiving the cushion pins, and the fastening holes are formed in two rows such that the holes in each row cross each other.

6. The apparatus as set forth in claim 1, wherein the spaces between each cushion unit gradually decrease as they proceed in the rearward direction, and the amount of cushion pins gradually decrease as well.

7. The apparatus as set forth in claim 1, wherein the slider is formed into an I-shaped member having a web and a pair of flanges formed at upper and lower ends of the web, the web being inserted into the guide slit of the guide rail with the upper flange being placed over the outer side of the guide rail, and wherein the slider includes at least two anti-shaking members at the front and rear portion thereof, and wherein the top portion of anti-shaking member abuts against the inner top surface of the guide rail preventing up-and-down movement of the slider.

8. The apparatus as set forth in claim 1, wherein the side fence includes a plurality of side bars, each of which consists of three separate bars coupled to one another in telescopic form.

9. The apparatus as set forth in claim 8, wherein the holding cover of the cushion unit is provided at both side portions thereof with a plurality of guide tunnels, for movably receiving the side bar of the side fence.

10. The apparatus as set forth in claim 1, further comprising an outer cover for enclosing the components of the apparatus.

11. The apparatus as set forth in claim 10, wherein the outer cover includes a plurality of middle covers coupled to each cushion unit for covering the cushion units, a front cover coupled to the foremost middle cover for covering the front portion of the foremost cushion unit, and a rear cover for covering the stopper, the covers being coupled to telescope over one another.

12. The apparatus as set forth in claim 11, wherein the stopper is formed into a truss type steel structure, the stopper including a pair of vertical posts supported by a slant support bar fixed to the ground, and a door for communicating with a box placed on the space formed therein.

13. The apparatus as set forth in claim 2, wherein the axial width of the holding cover is smaller than that of the base plate.

14. The apparatus as set forth in claim 1, wherein the guide rail is comprised of at least two guide rails arranged parallel to each other.

15. The apparatus as set forth in claim 2, wherein the cushion element is comprised of at least two cushion elements arranged in a row.

* * * * *